US008668047B2

(12) United States Patent
Pedicone, Jr.

(10) Patent No.: US 8,668,047 B2
(45) Date of Patent: Mar. 11, 2014

(54) TOEBOARD SYSTEM HAVING TELESCOPING, ARTICULATING AND INTERLOCKING MEMBERS

(76) Inventor: Francis A. Pedicone, Jr., Wilmington, DE (US)

( * ) Notice: Subject to any disclaimer, the term of this patent is extended or adjusted under 35 U.S.C. 154(b) by 58 days.

(21) Appl. No.: 13/180,121

(22) Filed: Jul. 11, 2011

(65) Prior Publication Data

US 2013/0015015 A1 Jan. 17, 2013

(51) Int. Cl.
*E04G 5/14* (2006.01)

(52) U.S. Cl.
USPC ..... 182/113

(58) Field of Classification Search
USPC ..... 182/113
See application file for complete search history.

(56) References Cited

U.S. PATENT DOCUMENTS

| | | | | |
|---|---|---|---|---|
| 852,172 | A | 4/1907 | Eschholz et al. | |
| 1,943,871 | A | 1/1934 | Landberg | |
| 2,226,359 | A | 12/1940 | Spencer | |
| 2,289,844 | A | 7/1942 | Lamb | |
| 2,332,477 | A | 10/1943 | Thornley | |
| 2,582,385 | A | 1/1952 | Knudsen | |
| 3,179,212 | A | 4/1965 | Gostling | |
| 3,480,257 | A | 11/1969 | Bourn et al. | |
| 3,613,832 | A | 10/1971 | Dunster | |
| 3,752,262 | A | 8/1973 | Helms | |
| 3,782,499 | A | 1/1974 | Fisher | |
| 3,785,602 | A | 1/1974 | Juculano | |
| 3,842,685 | A * | 10/1974 | Philpott et al. | 475/107 |
| 3,844,520 | A | 10/1974 | Werner et al. | |
| 3,848,854 | A | 11/1974 | De Barbieri | |
| 3,853,203 | A | 12/1974 | Werner et al. | |
| 3,863,899 | A | 2/1975 | Werner | |
| 4,111,579 | A | 9/1978 | Knight | |
| 4,219,175 | A | 8/1980 | Harig | |
| 4,236,698 | A | 12/1980 | Compte | |
| 4,304,078 | A * | 12/1981 | Meriwether, Jr. | 52/127.2 |
| 4,597,472 | A | 7/1986 | Hjelm | |
| 5,269,394 | A | 12/1993 | Haroldson, Sr. | |
| 5,285,869 | A | 2/1994 | Rock | |
| 5,400,870 | A | 3/1995 | Inoue | |
| 5,462,134 | A | 10/1995 | Van Helmond | |
| D372,989 | S | 8/1996 | Gile et al. | |
| 5,697,742 | A * | 12/1997 | House | 410/127 |
| 5,842,685 | A | 12/1998 | Purvis et al. | |
| 5,913,508 | A | 6/1999 | Eades | |
| 6,000,175 | A | 12/1999 | Gale et al. | |
| 6,112,854 | A * | 9/2000 | Davis | 182/113 |
| 6,210,090 | B1 * | 4/2001 | Wyse | 410/151 |

(Continued)

FOREIGN PATENT DOCUMENTS

| | | |
|---|---|---|
| WO | WO-2005083197 A1 | 9/2005 |
| WO | WO-2008089731 A1 | 7/2008 |

*Primary Examiner* — Alvin Chin Shue

(74) *Attorney, Agent, or Firm* — Novak Druce Connolly Bove + Quigg LLP

(57) ABSTRACT

A toeboard system for scaffolding has telescoping, articulating, and interlocking members. The telescoping member has inner and outer sleeves configured in telescope arrangement for linear extension of the inner sleeve. Connecting brackets are positioned between the telescoping member and the articulating member to facilitate rotational positioning of the articulating member. In addition, the telescoping member and the articulating member, respectively, include a mounting structure and a receiving structure, which are configured to interlock one toeboard system to another toeboard system. Alternative toeboard systems with the mounting structure and the receiving structure but without telescoping members or articulating members are also disclosed.

8 Claims, 8 Drawing Sheets

(56) References Cited

U.S. PATENT DOCUMENTS

| | | | | |
|---|---|---|---|---|
| 6,279,880 | B1 | 8/2001 | Hawks, Jr. | |
| 6,405,830 | B1 | 6/2002 | Hayman | |
| 6,976,557 | B2 * | 12/2005 | Becker | 182/113 |
| D596,761 | S | 7/2009 | Beland | |
| 2010/0078264 | A1 * | 4/2010 | Kreller | 182/113 |
| 2010/0224447 | A1 * | 9/2010 | Rogers | 182/222 |

* cited by examiner

TOEBOARD SYSTEM HAVING TELESCOPING, ARTICULATING AND INTERLOCKING MEMBERS

BACKGROUND

1. Field of the Invention

The field of the present invention relates generally to scaffolding toeboard systems, and more particularly to toeboard systems that may have telescoping, articulating, and interlocking members.

2. Background

Safety is a major concern for workers and others positioned on and under scaffolding, particularly when scaffolding is elevated at heights of six feet or higher. To assure safety standards and requirements are met at these heights, regulations specify that toeboards be installed on scaffolding structures.

Toeboards and toeboard systems are used as barriers along the perimeter of scaffold decks. These barriers prevent tools and other objects from falling or rolling off the deck. Toeboards and toeboard systems are, therefore, specifically positioned to block openings between a scaffold and scaffold deck. Toeboards also can prevent workers from stepping over the edges of a scaffold deck.

In construction industry practice, wooden boards conventionally are used as toeboards and implemented into toeboard systems. Typically, 2×4 inch and/or 2×6 inch wooden boards of various lengths are joined together and in turn coupled to a deck or rail of scaffold system using bailing wire to assure the safety of workers and others positioned on or under scaffolds. To accommodate considerable variations in deck lengths and widths, the wooden boards are cut to size for shorter distances or nailed together for longer runs. Boards are cut to different sizes as desired. Variations in the wooden boards can make it difficult to form a uniform toeboard. In addition, due to safety concerns and the eventual degradation of wood, wooden boards typically are not reused. This labor-intensive process consumes time and generates significant waste.

Though conventional toeboards and toeboard systems are suitable for their intended purpose, using wooden boards as components of toeboard systems has additional shortcomings. For example, wooden boards often are not suitable for use at job sites where scaffolds are positioned near high-temperature equipment (e.g., boilers). Under these conditions, among others, wooden boards often are susceptible to splitting, swelling, warping, etc.

Another shortcoming associated with the use of wooden boards is the relatively high cost of lumber. Extensive worldwide deforestation and related environmental and ecological problems have resulted in increased lumber prices. Moreover, diminishing supplies of lumber frequently give rise to delays in the delivery of lumber, resulting in periodic problems in meeting industry demand. In an effort to conserve natural resources, lumber alternatives should be explored.

Considering these concerns among others, there is clearly a need for improved scaffolding toeboard systems.

SUMMARY

Toeboards are installed about a perimeter of a scaffold deck. To accommodate scaffolds of various lengths and widths, the toeboard system of a first embodiment includes a telescoping member, connecting brackets, and an articulating member. The telescoping member has axially aligned inner and outer sleeves configured in telescope arrangement, with the inner sleeve slidingly engaged within the outer sleeve. The articulating member is rotatable from a first position axially aligned with the outer sleeve to a second position at an angle to such axis. In addition, the telescoping member and the articulating member, respectively, include a mounting structure and a receiving structure, which are adapted to interlock with separate toeboard systems.

In another embodiment, a toeboard system is formed as an open channel without a telescoping member or articulating member. This alternate toeboard system includes a mounting structure at a distal end and a receiving structure at a proximal end for coupling the toeboard system to other toeboard systems.

BRIEF DESCRIPTION OF THE DRAWINGS

The drawings described herein are for illustrative purposes only and are not intended to limit the scope of the present disclosure. In the drawings.

DETAILED DESCRIPTION

Figure 1:
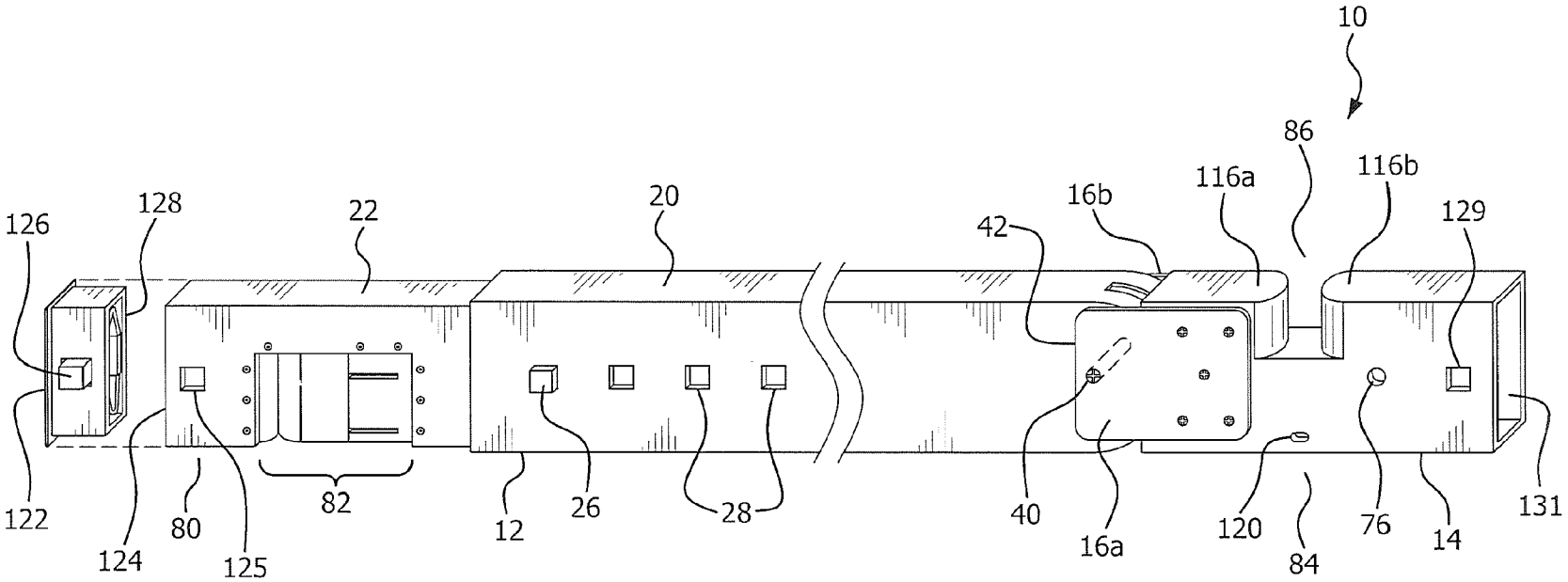
FIG. 1 is front perspective view of a first embodiment of a toeboard system.

Turning in detail to the drawings, FIG. 1 shows a toeboard system 10 for scaffolding. The toeboard system 10 includes a telescoping member 12, an articulating member 14, and connecting brackets 16*a*, 16*b*. The telescoping member 12 and the articulating member 14 also are configured as interlocking members so that additional toeboard systems may be attached thereto, as further described below.

Figure 3:
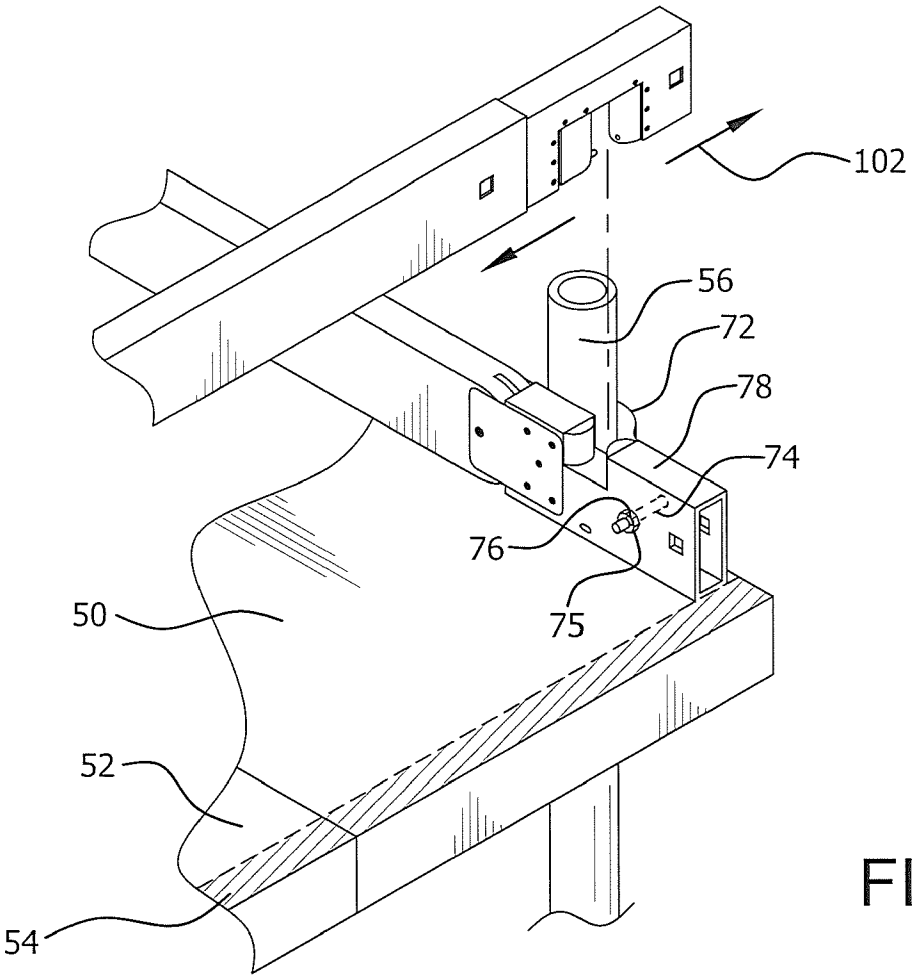
FIG. 3 is a right perspective view of a first toeboard system with a mounting structure in alignment with a receiving structure on a second toeboard system with the second toeboard mounted on a scaffold deck and joined to a post.

As used herein, a toeboard system 10 is broadly defined as one or more barriers erected along perimeter areas 54 of a work area 58, such as a scaffold deck 50, to identify to workers the perimeter of a scaffolding deck and to prevent material, tools, or objects from falling off of the work area (see FIG. 3). Such perimeter areas 54 are those adjacent to openings positioned between a work area 58 and scaffold posts 56 or scaffold railing (not shown). The openings include, but are not limited to, floor openings, wall openings and openings adjacent to platforms, runways, and ramps.

The toeboard system preferably should be formed or made of a material or materials capable of withstanding a force of up to at least about 50 lbf, when applied in any downward or horizontal direction at any point along the toeboard system. The materials may include steel, aluminum or other materials, having sufficient load bearing capabilities. The material also preferably should have sufficient corrosion resistance for frequent exposure to various weather conditions.

According to various state and federal safety standards, toeboards and/or toeboard systems must be used with scaffolding structures where there is a danger that items may fall through openings adjacent to elevated work areas such that material could strike persons, machinery, or other equipment on or below a scaffolding structure. According to U.S. Occupational, Health, and Safety (OSHA) standards, conventional toeboards must have at least a four inch height, when measured from a top surface to a bottom surface, and also must be securely fastened to scaffolds, such that there is no more than 0.25 inch clearance above the floor level or deck of a work area.

Figure 1A:
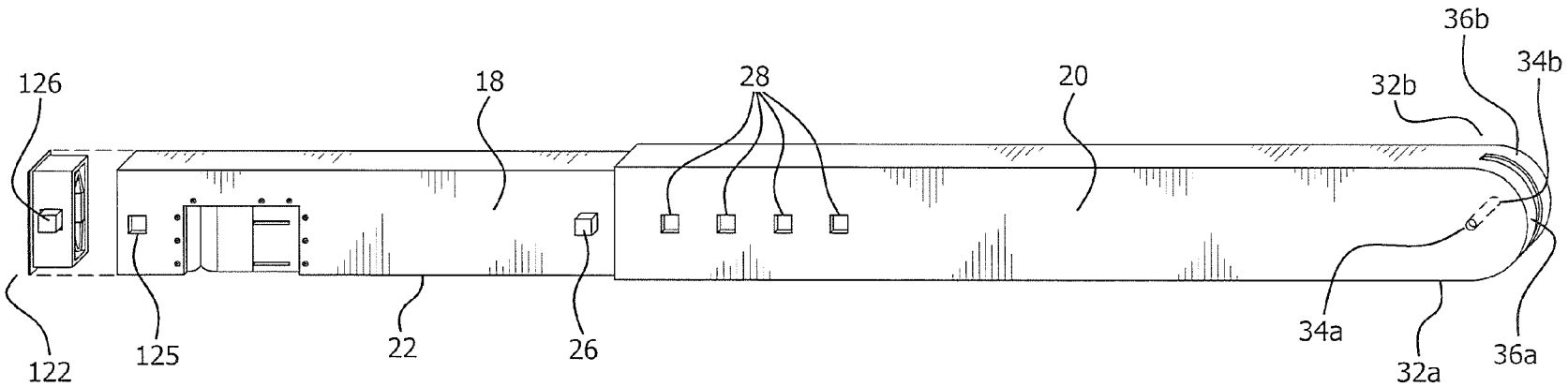
FIG. 1A is a front perspective view of a telescoping member.

Referring to FIGS. 1 and 1A, the telescoping member 12 has an outer sleeve 20 and an inner sleeve 22 configured in sliding telescope arrangement for longitudinal extension of the inner sleeve 22 from a first position of one length (FIG. 1) to at least a second position of longer length (compare FIG. 1A). The inner sleeve 22 is positioned within the outer sleeve 20 with an interference fit such that the inner sleeve 22 may be linearly adjusted within the outer sleeve 20. As shown particularly in FIGS. 1, 1A and 2, one or more protruding element(s) 26, such as snap fit, spring-loaded or otherwise resilient prong(s), may extend from an outer surface 18 or side surface of the inner sleeve 22. The protruding element(s) 26 engage with outer sleeve openings 28. As shown in FIG. 1, protruding element 26 engages one of the outer sleeve openings 28 to hold the inner sleeve 22 in a first relative position with respect to the outer sleeve 20. Comparing FIG. 1A, the inner sleeve 22 has been pulled or drawn out of the outer sleeve 20 such that the protruding element 26 does not engage any of the outer sleeve openings 28. Multiple outer sleeve openings 28 permit the protruding element 26 to be engaged along the length of the outer sleeve 20 to vary the overall length of the telescoping member 12 of the toeboard system 10.

The overall lengths of the outer and inner sleeves 20, 22 will vary, depending on the dimensions of the scaffold deck. The inner sleeve 22, however, has a length that is slightly longer than the outer sleeve 20 such that when the inner sleeve 22 is fully disposed within the outer sleeve 20, at least a portion of the distal end of the inner sleeve 22 is exposed outside of the outer sleeve 20. In one embodiment, the outer sleeve has a height of about 6.375 inches and a width of about 1.875 inches. The inner sleeve has a height of about 6.00 inches and a width of 1.75 inches. The material thickness of the sleeve is about 0.125 inches. Consistent with state and federal safety standards, in this embodiment the maximum allowable opening with the sleeve is about 1 inch.

The outer sleeve 20 includes end sections 32*a*, 32*b* which define openings 34*a*, 34*b*, as shown in FIG. 1A. Each end section 32*a*, 32*b* includes rounded edges 36*a*, 36*b*, which are configured for attachment to connecting brackets 16*a*, 16*b* (FIG. 1). In one embodiment, the radius of curvature of the rounded edges 36*a*, 36*b* is about 3.0 to 3.2 inches.

Figure 2:
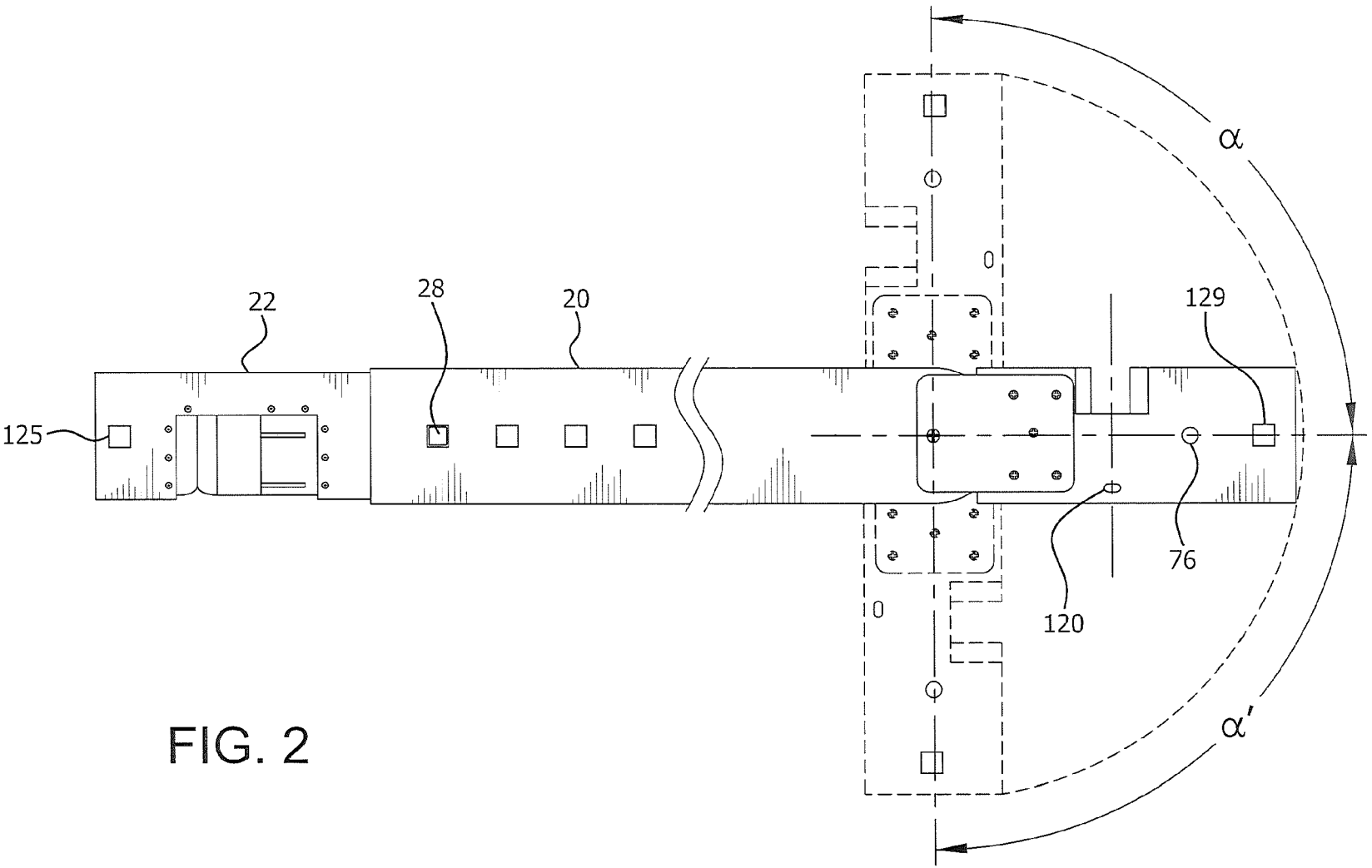
FIG. 2 is a front view of a toeboard system, illustrating the rotation of the articulating member.

As shown particularly in FIGS. 1 and 2, connecting brackets 16*a*, 16*b* are configured to couple to outer sleeve 20 and articulating member 14. Each bracket 16*a*, 16*b* is connected to end sections 32*a*, 32*b*. A rotational shaft or linkage 42 may extend through openings 34*a*, 34*b*. The rotational shaft or linkage may comprise positioning element(s) 40, such as a nut and bolt combination or other elements adapted to securely extend through the brackets 16*a*, 16*b* and the outer sleeve 20 and facilitate rotation of the articulating member 14 about a pivot point defined by the rotational shaft or linkage. As represented by dashed lines in FIG. 2, articulating member 14 is adapted to rotate with an angular displacement indicated by $\alpha$ and $\alpha'$. In some embodiments such as illustrated in FIG. 2, $\alpha$ and $\alpha'$ are 90° above and 90° below, respectively, the theoretical axis X defined by the lengthwise axis of the outer sleeve 20. In one embodiment, the articulating member has a height of about 6.375 inches and a width of about 1.875 inches. The material thickness of the articulating member is about 0.125 inches. And, consistent with state and federal safety standards, in this embodiment, the maximum allowable opening within the member is about 1 inch.

Connecting brackets 16*a*, 16*b* also are connected to articulating member 14, using fasteners 46. The brackets 16*a*, 16*b* may be made from steel, aluminum or other material having sufficient load bearing capabilities to withstand frequent positioning of the articulating member. This material preferably has sufficient corrosion resistance for frequent exposure to various weather conditions.

Figure 5:
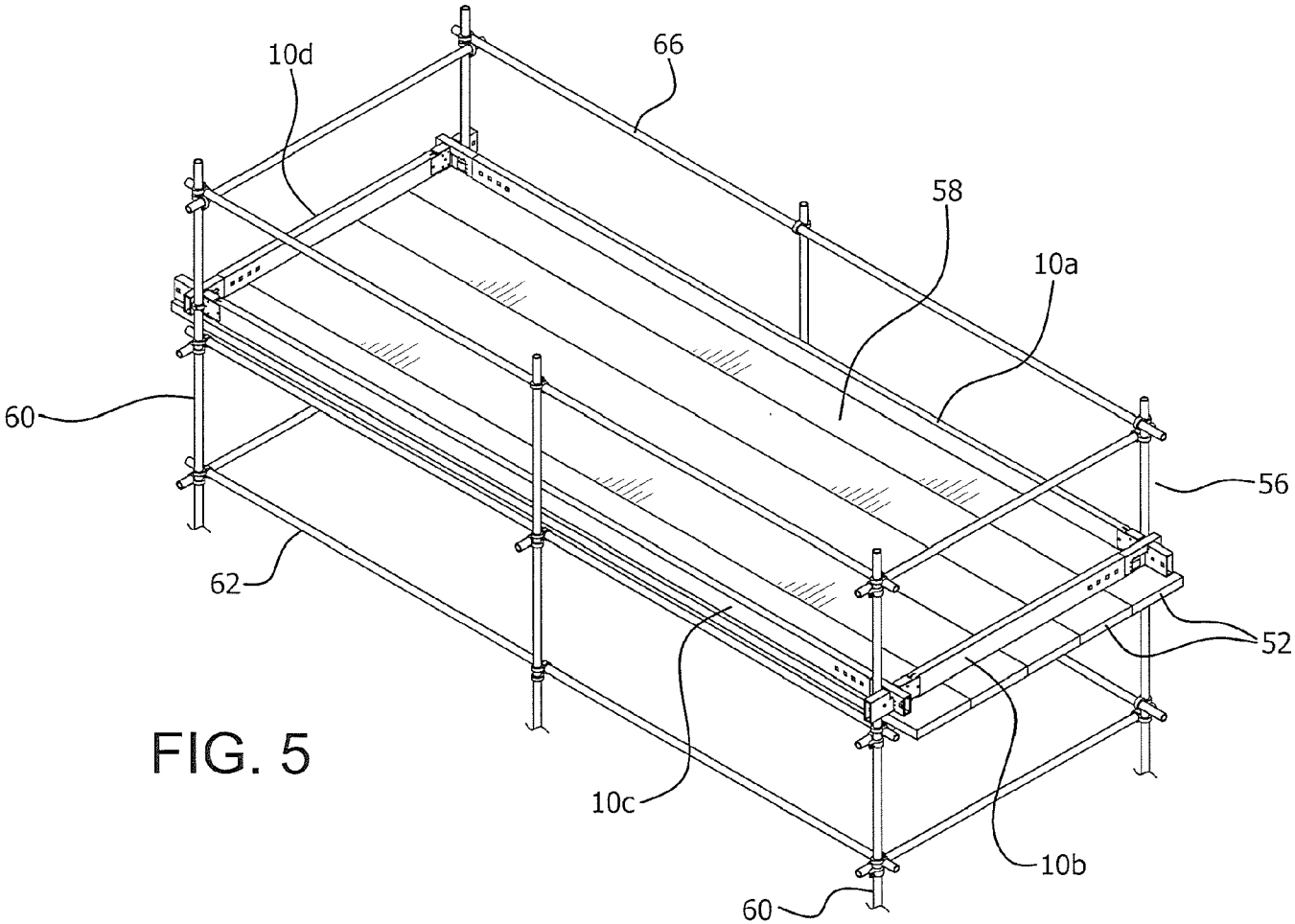
FIG. 5 is a right perspective view, showing a plurality of toeboard systems mounted onto perimeter areas of a scaffold deck.
Figure 6A:
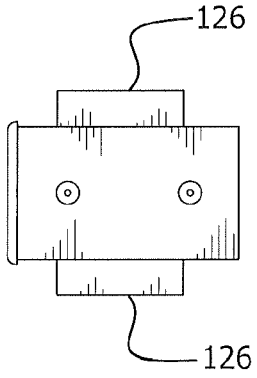
FIGS. 6A, 6B, and 6C are top, side, and front views, respectively, of an end cap.
Figure 6B:
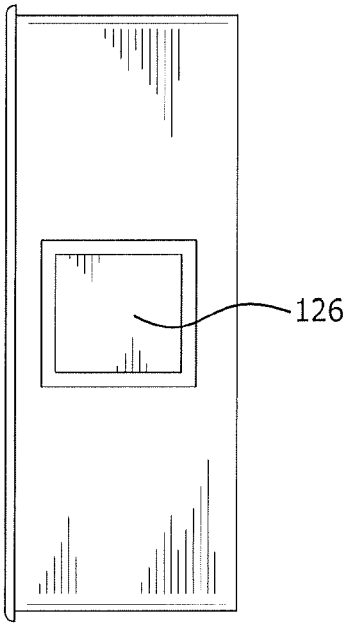
Figure 6C:
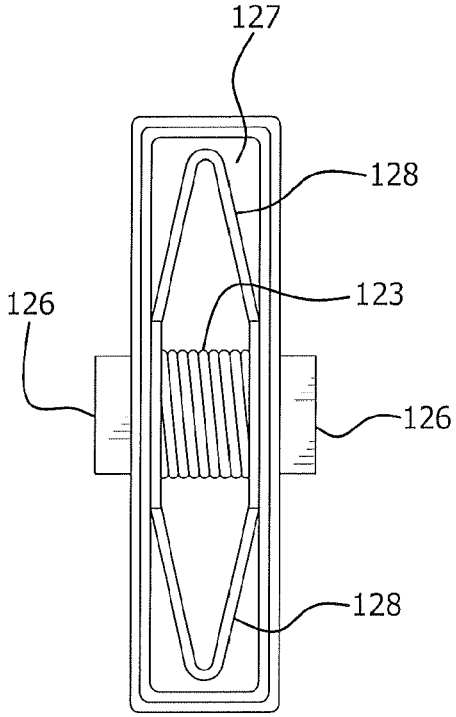

As shown in FIGS. 3 and 5, when the toeboard system 10 is installed, the telescoping member 12, articulating member 14, and connecting brackets 16*a*, 16*b* are positioned to rest on perimeter areas 54 of a scaffold deck 50. A scaffold deck 50 includes a plurality of metal or wooden planks 52, which are secured to a scaffold system 56 with inter alia vertical supports, horizontal supports and railings.

The toeboard systems 10 of the invention may be installed on scaffold systems 56, including commercial and industrial grade scaffolding systems. These scaffolding systems typically are metal structures, which include posts or vertical supports 60, transverse horizontal supports 62, longitudinal horizontal supports 64, and hand rails 66. These types of structures may also include cross-member supports (not shown), and gates (not shown). Exemplary scaffold systems include those manufactured by Safway Services LLC, Waco Scaffolding & Equipment Co., and United Scaffolding, Inc. Commonly known scaffolding systems are sold under the trademarks Systems™ Scaffold, Interstate™ and Superior™ scaffolding. The toeboard system 10, however, may be used with any scaffold or scaffold system that has sufficient strength for attachment using clamps or other suitable positioning elements, as further described below.

In an exemplary scaffolding system 56, shown in FIG. 5, planks 52 are configured to rest on supports 60, 62 and to extend along the scaffold deck 50, forming a work area 58 (FIG. 5). Between the scaffold deck 50 and the hand rails 66, openings exist. A plurality of toeboard systems 10 may be installed to create a perimeter barrier to retain persons and/or equipment and/or tools or construction items or debris within the work area of the scaffold deck 50.

As shown particularly in FIG. 3, an anchoring element 72 is coupled to the scaffold 56 and to the articulating member 14 to securely fasten a toeboard system 10 to a post or vertical support 60. The type of anchoring element used depends upon the scaffold design. However, where the scaffold is a structure that uses tube-shaped vertical supports or posts, the anchoring element 72 is a clamp mechanism. Suitable clamp mechanisms include CRA19 Right Angle Clamps and MS2R Military Right Angle Clamps. The anchoring element 72 has a bolt end 74 configured to extend through a hole 76 (see FIG. 1) located at or near a distal end 78 of the articulating member 14. The bolt end 74 is then secured using a nut 75 or other similar fastening mechanism.

Where a scaffold deck 50 has a plurality of perimeter areas 54, multiple toeboard systems are used to create a perimeter barrier. FIG. 5 illustrates the positioning and interlocking of multiple toeboard systems 10*a*, 10*b*, 10*c*, 10*d* at angles to one another. Two toeboard systems also may be joined together in axial alignment.

To interlock one toeboard system to another toeboard system at angles to one another, each toeboard system 10 has a first end member 80, having a mounting structure 82 and a second end member 84, having a receiving structure 86. The mounting structure 82 and receiving structure 86 are configured to interlock with additional toeboard systems in a substantially perpendicular arrangement, as shown in FIGS. 3 and 5.

Figure 4:
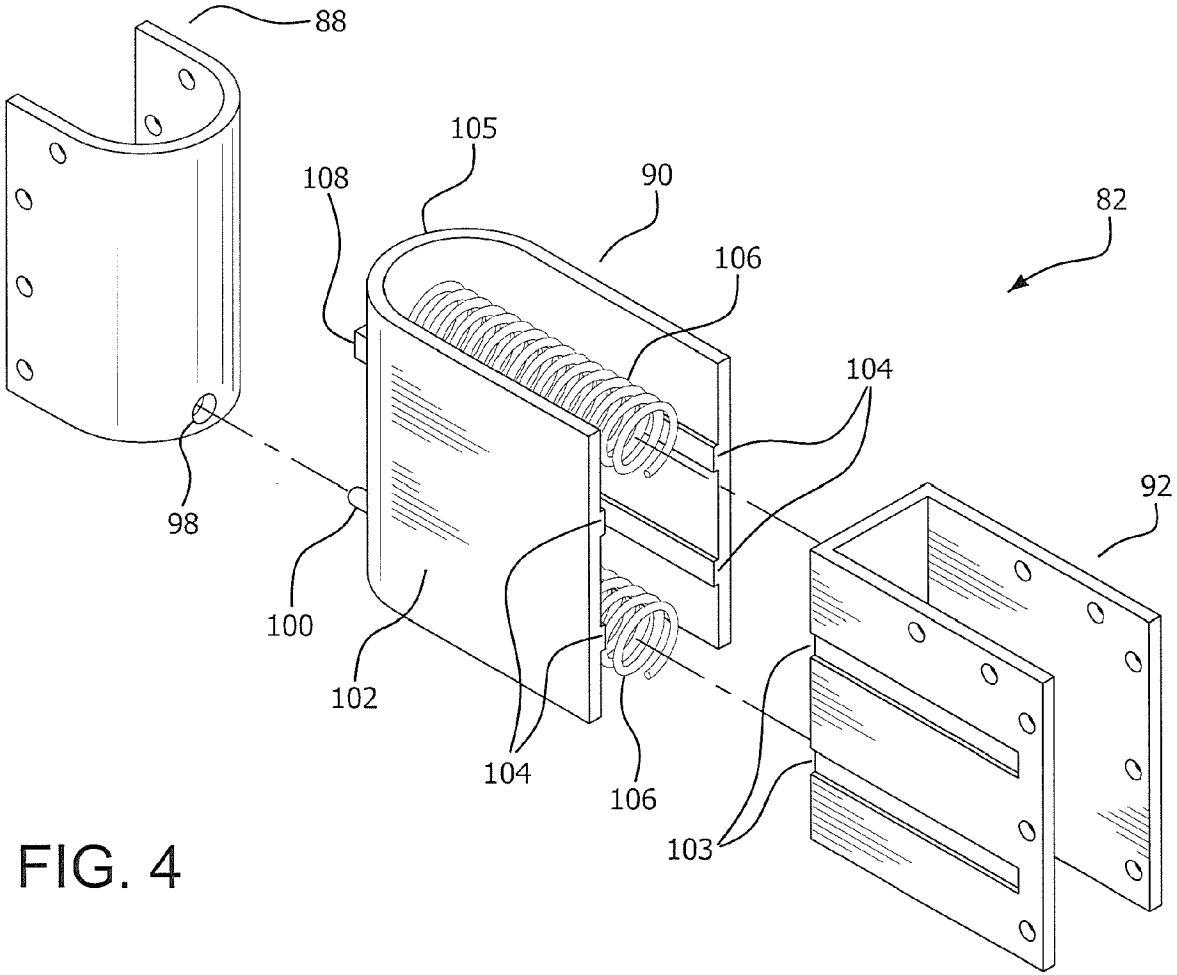
FIG. 4 is a right perspective exploded view of aligned elements of a mounting structure.

As shown in FIG. 4, mounting structure 82 assembly includes a fixed element 88, a retractable element 90 adapted to mate with a portion of the fixed element 88, and a catch element 92. When assembled, the fixed element 88 and the catch element 92 are coupled to the inner wall 79 of the first end member 80, such as on within the inner sleeve 22 as shown in FIG. 1. Optionally, mounting brackets (not shown) are placed between the fixed element 88 and the inner wall 79. However, fasteners 96 alone, such as rivets, may be used. As shown in FIG. 4, the fixed element 88 has a thin-walled body having an elongated shape and a rounded end. The fixed element also has a pin opening 98, configured to receive pin 100 positioned on the retractable element 90 for mating engagement of the retractable element 90 to the fixed element 88.

When the mounting structure 82 is in a closed position, as shown in FIGS. 1, 1A, and 2, the retractable element 90 is configured to mate with a catch element 92 and a fixed element 88. The retractable element 90 also has a thin-walled body 102, which is shaped to have mounting sections 104 that protrude inwardly to mate with grooves 103 in the catch element 92.

The mating end 105 of the retractable element has a pin 100, which is fixed to the body 102. The pin 100 is slightly elongated to assure proper fit with the pin opening 98 in the fixed element 88. Disposed within the retractable element are springs or other resilient or elastic elements 106. These elements 106 are coupled to the catch element 92 and to an internal surface at the mating end 105 of the retractable element 90, using retraction positioning elements 108. Suitable elastic elements include springs, dampers and other types of elastic components.

As shown in FIG. 4, the catch element 92 has a thin-walled body 110 configured with grooves 103 in its external surfaces to receive mounting sections 104 of the retractable element 90. The catch element 92 optionally is coupled to the inner wall 79 of the first end member 80, using receiving brackets (not shown).

To interlock the mounting structure 82 with the receiving structure 86, the retractable element 90 is positioned spaced apart from the fixed element 88, as indicated by arrows 102 (FIG. 3) such that the elastic elements 106 are compressed and the mounting sections 104 mate with grooves 103. The mounting structure 82 is then positioned over the receiving structure 86, as shown in FIG. 3.

Figure 1B:
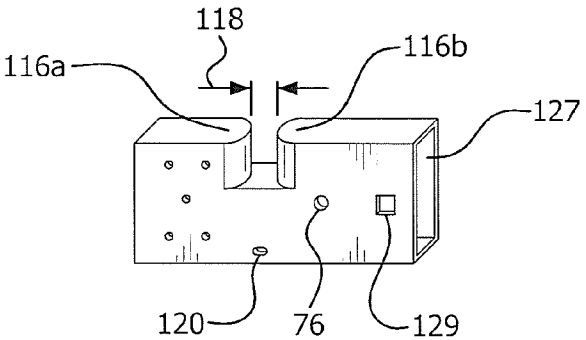
FIG. 1B is a front perspective view of an articulating member.

As shown in FIGS. 1 and 1B, the receiving structure 86 includes locating elements 116*a*, 116*b*, which define a gap 118 and a receiving pin opening 120. The gap 118 is of sufficient width to position the mounting structure 82 of a second toeboard system over the receiving structure 86. The receiving pin opening 120 preferably has an oblong shape to facilitate positioning of a pin (not shown), upon release of the retractable element 90.

Figure 7:
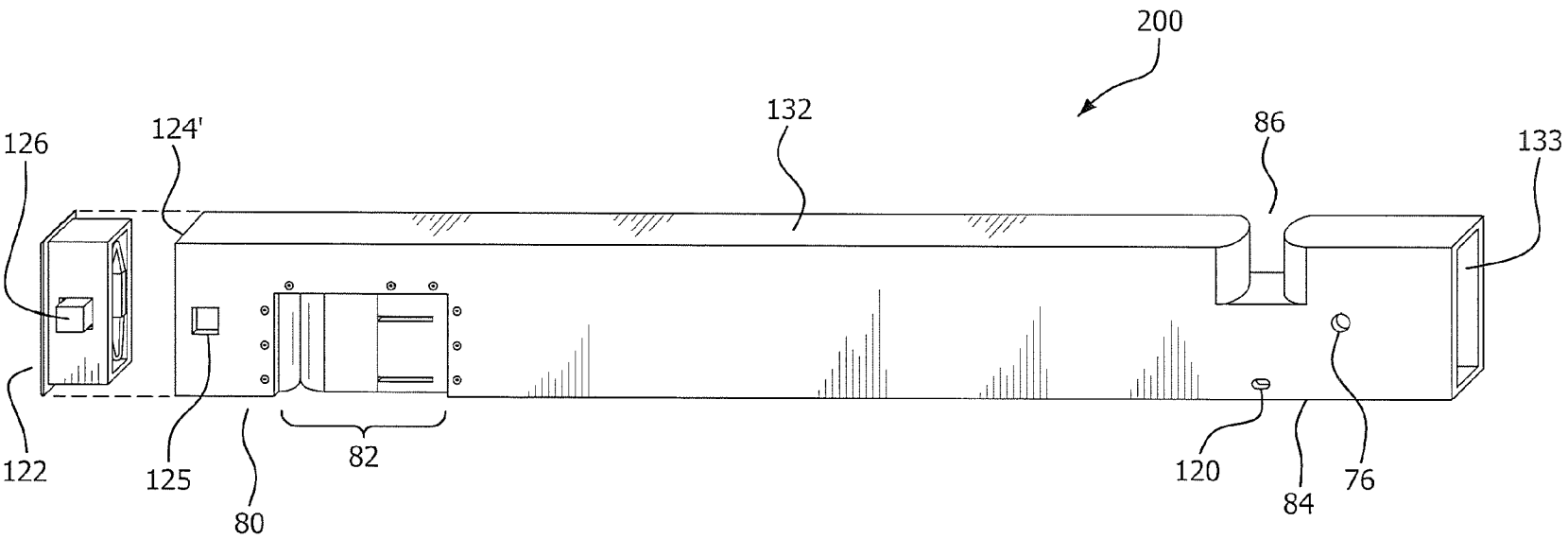
FIG. 7 is a front perspective view of a second embodiment of a toeboard system.

FIG. 7 shows a separate embodiment of a toeboard system 200 formed as a hollow generally rectangular tube of a defined length without a telescoping member and without an articulating member. This type of toeboard system 130 is configured to rest on perimeter areas of shorter length, which are typically four feet or less. Such an alternative toeboard system 200 has mounting structure 82 and receiving structure 86 and can be used to form a protective perimeter for scaffolding in conjunction with multiple other toeboard systems 200 or multiple other toeboard systems 10 or any desired combination of toeboard systems 10, 200.

The opening 133 at one end of the toeboard system 200 may also be raised to form a stepped section (not shown), having a height and a width slightly greater than the height and width of the articulating member or the telescoping member of alternative toeboard system 10. In one embodiment of the toeboard system 200, at the end forming the opening 133, the height is about 6.3 to 6.4 inches and the width is about 1.8 to 2.0 inches, with the stepped section having a height of about 0.125 inches, when measured from a generally flat horizontal top portion of locating element 116*b*. The slightly larger opening 133 can accommodate insertion of an end cap having protrusions, an articulating member or a telescoping member of an adjacent toeboard system 10 to permit joining toeboard systems together in axial alignment to form longer lengths.

As shown particularly in FIGS. 1, 6A-6C, and 7, each toeboard system 10, 200 may be provided with one or more end caps 122. These end caps are configured for insertion into the end 124 of the telescoping member 18 of the toeboard system 10 or the end 124' of the nontelescoping toeboard system 200. Each end cap 122 includes resilient prongs, buttons or push elements 126 and cap springs or elastic elements 128. Each push element 126 is coupled to a shaft member 123 and extends through end openings 125. To cover the ends 124, a user applies a compressing force onto the push elements 126 that in turn compresses the cap elastic elements 128 to least partially seat the push elements within a cavity 127 of the end cap 122. With the push elements 126 so compressed, the end cap 122 is slid into the hollow cavity of the first end member 80. Upon proper positioning, the push elements 126 are released and project through end openings 125. The cap elastic elements 128 may be configured as shown or may be a spring or other elastic element coupled to the shaft member 123 and the push elements 126.

If desired, a telescoping member 12 of a first toeboard system 10 may be inserted into an open end of an articulating member 14 of an adjacent toeboard system 10 to join two toeboard systems together in axial alignment. In such configuration, the telescoping member 12 of a first toeboard system 10 is inserted into the opening 131 of the articulating member 14 of a second adjacent toeboard system 10. The push elements 126 of the end cap 122 of the telescoping member 12 of the first toeboard system 10 mate with openings or holes 129 of the second toeboard system 10. When not compressed, the push elements 126 extend a sufficient height to pass through end openings 125 and openings or holes 129, thus locking the first and second toeboard systems together lengthwise or in axial alignment. In similar manner either a telescoping member 12 or an articulating member 14 of a first toeboard system 10 may be inserted into an open end 133 of an alternative toeboard system 200.

Thus, toeboard systems having telescoping, articulating, and interlocking members are disclosed. While embodiments of this invention have been shown and described, it will be apparent to those skilled in the art that many more modifications are possible without departing from the inventive concepts herein. The invention, therefore, is not to be restricted except in the spirit of the following claims.

What is claimed is:

1. A toeboard system for scaffolding, comprising:

a telescoping member with an inner sleeve slidingly received within an outer sleeve so that the inner sleeve may be moved from at least a first position defining a first toeboard length to at least a second position defining a second toeboard length that is longer than the first toeboard length, the telescoping member comprising a first end member including a mounting structure with a fixed element, a retractable element with elastic elements disposed therein, and a catch element, wherein the retractable element has a thin-walled body shaped to have mounting sections that protrude inwardly to mate with grooves in the catch element;

an articulating member coupled to the telescoping member for rotational movement from a first position aligning a longitudinal axis of the articulating member with a longitudinal axis of the outer sleeve to a second position wherein the longitudinal axis of the articulating member is at an angle to the longitudinal axis of the outer sleeve, the articulating member comprising a second end member including a receiving structure with locating elements that define a gap, wherein the mounting structure and the receiving structure are interlockable with other toeboard systems.

2. The toeboard system of claim 1, further comprising at least one connecting bracket coupled to the telescoping member and the articulating member.

3. The toeboard system of claim 1, further comprising:

a protruding element extending from a surface of the inner sleeve engageable with one or more openings defined by the outer sleeve.

4. The toeboard system of claim 1, wherein the articulating member defines a hole at or near a distal end of the articulating member for receiving means to join the articulating member to scaffolding structure.

5. The toeboard system of claim 1, further comprising an end cap engagable with the articulating member or with the telescoping member.

6. The toeboard system of claim 1, wherein a receiving pin opening is located in the receiving structure.

7. The toeboard system of claim 1, wherein the fixed element and the catch element are coupled to an inner wall of the first end member.

8. The toeboard system of claim 1, wherein the elastic elements are coupled to the catch element and to an internal surface of the retractable element.

* * * * *